United States Patent [19]

Nakai et al.

[11] 4,063,399

[45] Dec. 20, 1977

[54] COIN WRAPPING DEVICE IN WRAPPING APPARATUS

[75] Inventors: Shiro Nakai; Minoru Nakamura, both of Himeji, Japan

[73] Assignee: Glory Kogyo Kabushiki Kaisha, Japan

[21] Appl. No.: 736,184

[22] Filed: Oct. 27, 1976

[30] Foreign Application Priority Data

Oct. 27, 1975 Japan ..... 50-146260[U]

[51] Int. Cl.[2] ..... B65B 57/20; B65B 11/04

[52] U.S. Cl. ..... 53/59 R; 53/212

[58] Field of Search ..... 53/212, 59 R

[56] References Cited

U.S. PATENT DOCUMENTS

| | | | |
|---|---|---|---|
| 3,878,666 | 4/1975 | Itoda et al. | 53/212 |
| 3,905,176 | 9/1975 | Ushio | 53/212 |

*Primary Examiner*—Travis S. McGehee

*Attorney, Agent, or Firm*—Wenderoth, Lind & Ponack

[57] ABSTRACT

A coin wrapping device incorporated in a coin wrapping apparatus has a main guide member and an auxiliary guide member provided between each pair of adjacently disposed wrapping rolls, so that these members are movable in synchronism with the movements of the wrapping rolls in accordance with the setting thereof for the denomination of coins being wrapped, and the inner surfaces of the end portions of the members define a cylindrical space between the wrapping rolls.

2 Claims, 3 Drawing Figures

COIN WRAPPING DEVICE IN WRAPPING APPARATUS

BACKGROUND OF THE INVENTION

This invention relates to a coin wrapping apparatus, and more particularly to a coin wrapping device used in a coin wrapping apparatus, wherein a stack of a predetermined number of coins is clamped and rotated between a plurality of coin wrapping rolls and is wrapped by a piece of paper, the lateral edges of the paper being fold crimped.

A typical example of the coin wrapping apparatus known heretofore has a construction wherein a predetermined number of coins counted by a coin counter are successively sent into a coin aligning cylinder in which the coins are arranged into a stack, the stack of coins being guided by a coin transfer mechanism toward a coin wrapping device comprising a plurality of coin wrapping rolls, which when moved inward, clamp and rotate the stack of coins and wrap the same with a piece of wrapping paper, the lateral edges of which extending outward from the two ends of the stack are thereafter fold crimped to form firm beads by which the paper is maintained in a tightly wrapped state.

In the such a coin wrapping apparatus, however, the coin aligning cylinder must be so constructed that the inner diameter thereof is regulatable for adapting to various denominations of the coins, or the coin aligning cylinder must be interchangeable with others adapted for respective denominations of coins. Such a feature complicates the coin wrapping apparatus. Furthermore, since the coin aligning cylinder is interposed in series between the coin supplying device and the coin wrapping device, the provision of the coin aligning cylinder of the aforementioned construction requires considerable space, thus increasing the size of the coin wrapping apparatus.

For obviating the above mentioned drawbacks of the conventional coin wrapping apparatus, there has been proposed a coin wrapping device wherein the aforementioned coin aligning cylinder is omitted, and the coins passing through the counter are introduced directly into a space formed between the wrapping rolls of the coin wrapping device, whereby the coins are arranged therein into a stack of coins each containing a predetermined number of coins of a specific denomination. However, the number of the wrapping rolls is ordinarily selected to be three, and therefore the coins from the counter have frequently failed to enter the space formed by the wrapping rolls and be formed into a neat stack within the space, thus causing unsatisfactory wrapping of the stack of coins.

SUMMARY OF THE INVENTION

With the above described problems of the conventional coin wrapping devices in view, a primary object of the present invention is to provide a coin wrapping device of the above described kind in which these problems are solved, and which has a simple construction and is economical to manufacture and in operation.

Another object of the invention is to provide a coin wrapping device of the above described kind, wherein a cylindrical space having a substantially circular cross-sectional configuration can be obtained between the wrapping rolls, and thereby the coin aligning cylinder of the conventional coin wrapping device can be eliminated.

Still another object of this invention is to provide a coin wrapping device wherein main and auxiliary guide members, which are movable in conformance with the denomination of the coins, are provided, whereby the inner surface of the cylindrical space is made substantially smooth.

These and other objects of the present invention, which will become apparent hereinafter, can be achieved by a coin wrapping device incorporated in a coin wrapping apparatus of a type wherein a predetermined number of coins are arranged therein into a stack of coins; a plurality of wrapping rolls are pressed against the circumferential surface of the stack of coins for imparting rotation to the stack of coins; a piece of wrapping paper is wound around the stack of coins; and the lateral edges of the wrapping paper are then fold crimped, the coin wrapping device comprising a main guide member and an auxiliary guide member provided between each set of adjacent wrapping rolls, the inner surfaces of the end parts of said main and auxiliary guide members, in combination, defining a cylindrical space for receiving said coins and arranging said coins in the form of a stack, and means for moving said main and auxiliary guide members in synchronism with the movements of said wrapping rolls in accorcance with the setting thereof for the denomination of coins.

The nature, principle, and the utility of the coin wrapping device according to this invention will be more fully understood when read in conjunction with the accompanying drawings wherein like members and parts are designated by like reference numerals.

DETAILED DESCRIPTION

Figure 1:
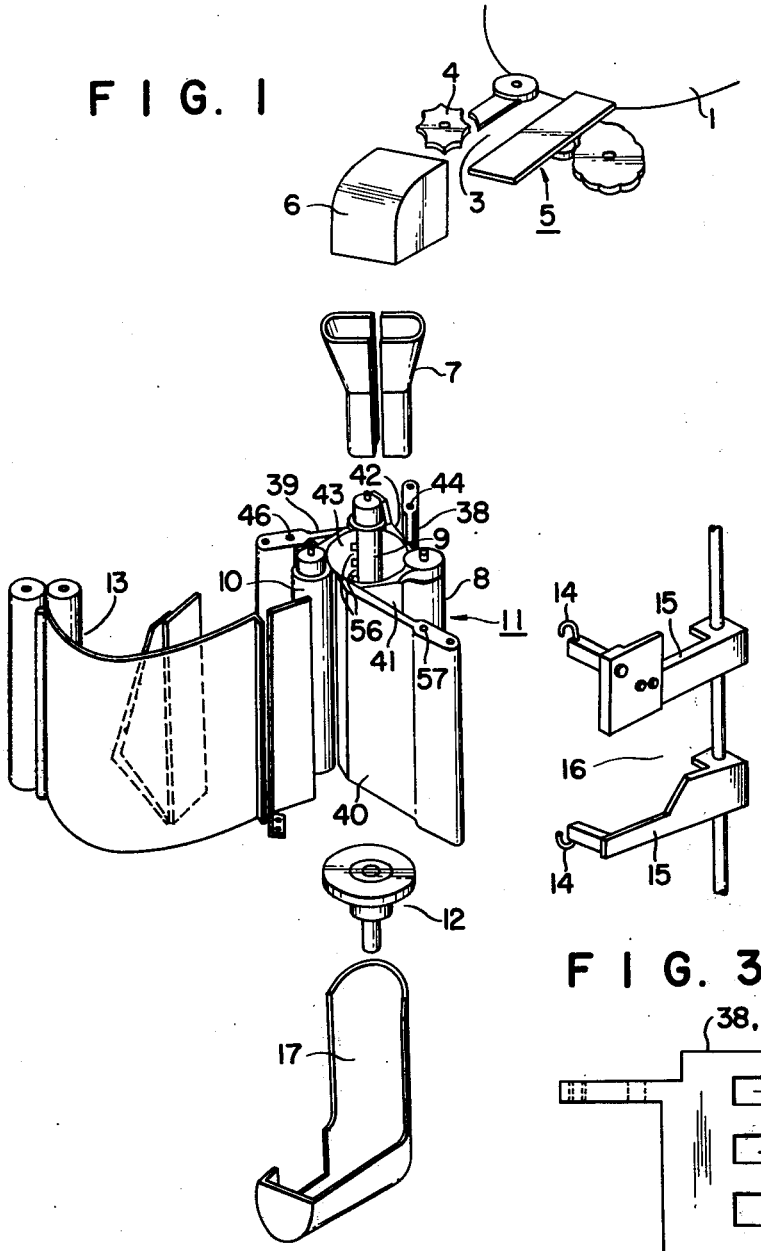
FIG. 1 is an exploded perspective view showing the general construction of a coin wrapping apparatus in which a coin wrapping device of the present invention is incorporated.
Figure 3:
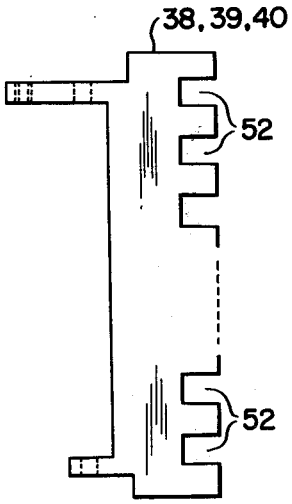
FIG. 3 is an elevational view of a main guide member used in the coin wrapping device of this invention.

Referring first to FIG. 1, there is shown a coin wrapping apparatus comprising a coin supplying device wherein coins received on a turntable 1 are moved along the periphery under centrifugal force so as to be delivered through a gate, provided along the periphery, one by one by the aid of a coin transferring mechanism (not shown) into a coin passage 3 in which coins are counted by a coin counting mechanism 4. The apparatus further comprises coin guiding members 6 and 7 for changing the transferring direction of the coins, a coin wrapping device 11 provided directly below the guide member 7 and including three coin wrapping rolls 8, 9, and 10, coin supporting means 12 for supporting coins introduced into the coin wrapping device 11, a wrapping paper feeding device 13 for supplying a piece of wrapping paper to the circumference of the coins clamped between and rotated by the coin wrapping rolls 8, 9, and 10 of the coin wrapping device 11, an edge crimping mechanism 16 having arms 15 provided with fold crimping hooks 14, respectively, operable for fold-crimping laterally projecting edges of the wrapping paper wrapped around the coins, and a chute 17 for receiving the thus wrapped stack of coins when it is dropped downward, all of the aforementioned members, mechanisms, and devices being operated with respective timings determined by cams, gear wheels, and the like of the driving system (not shown) of the coin wrapping apparatus.

Figure 2:
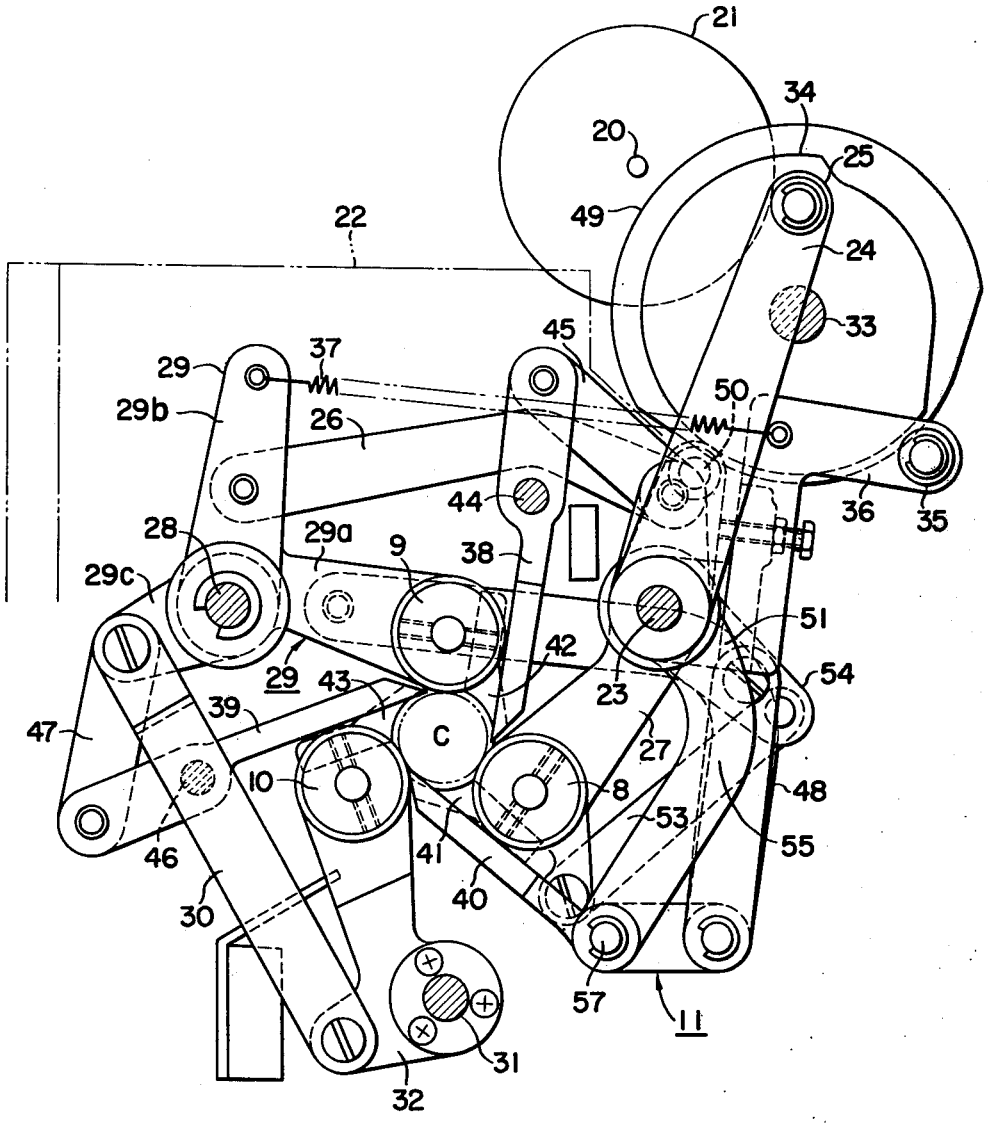
FIG. 2 is a plan view, partly in section, of an important part of the coin wrapping device according to the present invention.

FIG. 2 illustrates a practical example of the coin wrapping device 11 according to this invention, which is set for wrapping coins of the smallest outer diameter. The coin wrapping rolls 8, 9, and 10 are supported at the vertices of a substantially equilateral triangle by a link mechanism in a manner such that they are movable toward or away from the center of the triangle.

The link mechanism comprises a cam 21 fixedly mounted on a cam shaft 20, on which a knob (not shown) for setting the operation of the coin wrapping device for a denomination of coins C is further secured. A roller 25 provided at the distal or outer end of an arm 24 fixedly mounted on a shaft 23 rotatably supported by a structural plate 22 is pressed against the cam 21. Two horizontally extending supporting levers 27 disposed one above the other have their middle parts fixedly mounted on the shaft 23 and, on the ends thereof extending in one direction, rotatably support the upper and the lower shaft ends of the first wrapping roll 8. The other end of one of the arms 27, is pivotally connected with one end of a link member 26.

Likewise, two horizontally extending levers 29 disposed one above the other for rotatably supporting the second wrapping roll 9 are at their middle parts fixedly mounted on a vertical shaft 28 rotatably supported by the structural plate 22, and the other end of the link member 26 is pivotally connected with one arm of one of the levers 29. The upper lever 29 for rotatably supporting the second wrapping roll 9 has three arms 29*a*, 29*b*, and 29*c*. The arm 29*a* rotatably supports the upper end of the second wrapping roll 9, while the arm 29*b* is pin connected to the link member 26. A link member 30 is pin connected at its one end to the outer end of the arm 29*c*. The lower end of the second wrapping roll 9 is supported on an arm of the same shape as the arm 29*a* of the other lever 29.

The link member 30 is pin connected at its other end to the outer end of one arm of one of two supporting levers 32 fixedly mounted on a shaft 31 and rotatably supporting the third wrapping roll 10 at the ends thereof. The shaft 31 is rotatably supported by the machine structure.

A vertical cam shaft 33 for determining the operational timing of each of the various functioning parts of the coin wrapping apparatus including the above described coin wrapping device supports a cam 34 fixedly mounted thereon and contacted by a roller 35 rotatably supported on one end of a lever 36 loosely fitted on the above described shaft 23. A tension spring 37 is stretched between this lever 36 and the arm 29*b* of the lever 29 for supporting the second wrapping roll 9 to ensure positive contact of the roller 35 against the cam 34.

In the peripheral parts of the space formed between the three wrapping rolls 8, 9, and 10 for receiving a coin stack and between respective pairs of adjacent wrapping rolls, there are provided main guide members 38, 39, and 40 and auxiliary guide members 41, 42, and 43. The first main guide member 38 is loosely fitted on a vertical shaft 44 and has one end linked by a link member 45 to one of the above described levers 27 for supporting the first wrapping roll 8. The second main guide member 39 is loosely fitted on a vertical shaft 46 and has one end linked by a link member 47 to the arm 29*c* of the lever 29 for supporting the second wrapping roll 9. The third main guide member 40 is linked at one end thereof by a link member 48 to the arm 29*a* of the lever 29 for supporting the second wrapping roll 9. The third main guide member 40 is pin connected at an intermediate part thereof to one end of a lever 51 loosely fitted on the shaft 23. The other end of the lever 51 rotatably supports a roller 50 in contact with a cam 49 provided on the aforementioned cam shaft 33.

The main guide members 38, 39, and 40 have respective working ends which are beveled on their back faces to form acute tip edges, which are tangently directed with respect to the space for receiving a coin stack between the wrapping rolls. The tip edge of the first main guide member 38 extends to the vicinity of that part of the first wrapping roll 8 which faces the coin stack receiving space between the wrapping rolls. Similarly, the tip edges of the second and third main guide members 39 and 40 respectively extend to the vicinity of those parts of the second and third wrapping rolls 9 and 10 which respectively face the coin stack receiving space.

Each of the main guide members 38, 39, and 40 has at its working end part a plurality of cutouts 52.

On the one hand, the second and third auxiliary guide members 42 and 43 of the three auxiliary guide members 41, 42 and 43 are respectively fixed to the above described levers 29 and 32 for supporting the second and third wrapping rolls, while the first auxiliary guide member 41 is loosely fitted on the shaft of the first wrapping roll 8 and is linked at its one end by a link member 53 to one end of a lever 54 loosely fitted on the shaft 23. This lever 54 is pin connected to one end of a link member 55 which is pin connected at its other end to one end of the third main guide member 40.

The auxiliary guide members 41, 42, and 43 have respective working end edges provided with projections 56, as shown in FIG. 1, which respectively fit into the cutouts 52 formed in the tip edges of the main guide members 38, 39, and 40. Furthermore, each of these auxiliary guide members has a concave arcuate surface facing the coin stack receiving space.

The above described embodiment of the present invention operates as follows.

Upon turning the denomination setting knob (not shown) to a position selected for the coins to be wrapped, the cam 21 is thereby rotated, turning the arm 24 in clockwise or counterclockwise direction as viewed in FIG. 2, which in turn rotates the vertical shaft 23 together with the first wrapping roll supporting levers 27 fixedly mounted on the shaft 23. The rotation of the levers 27 moves the first wrapping roll 8 to a position corresponding to the denomination of coins set by the setting knob (not shown).

The rotation of the first wrapping roll supporting levers 27 through the link member 45 causes the first main guide member 38 to rotate clockwise around the shaft 44, and furthermore, through the link member 26, causes the second wrapping roll supporting levers 29 to rotate clockwise around the shaft 28, thereby bringing both the second wrapping roll 9 and the second auxiliary guide member 42 to their set positions. Turning of the second wrapping roll supporting levers 29 in turn rotates, through the link member 47, the second main guide member 39 clockwise around the shaft 46, and simultaneously therewith, through the link member 30, rotates the third wrapping roll supporting levers 32 clockwise, thereby bringing the third wrapping roll 10 to its set position. The turning of the second wrapping roll supporting levers 29 furthermore, through the link member 48, rotates the third main guide member 40 around the pin 57 clockwise to its set position. The rotation of the third main guide member 40 in turn, through the link member 55, rotates the arm 54 around the shaft 23 clockwise, thus rotating the first auxiliary guide member 41, through the link member 53, around the shaft of the first wrapping roll 8 clockwise.

By the above described setting operation, the apparatus is now ready for receiving the coins of a denomination for which the apparatus is set as described above.

When a predetermined number of coins are counted in the coin supplying device 5, and drop into the space surrounded by the coin wrapping rolls 8, 9, and 10, the coins are received on the coin supporting means 12 positioned below the space. Then, in accordance with the rotation of the cam shaft 33, the cam 34 is caused to be rotated, and the lever 36, one end of which is contacting with the cam 34, is rotated around the shaft 23 in the counterclockwise direction. The rotation of the lever 36 rotates the second wrapping roll supporting levers 29 in the counterclockwise direction through the tension spring 37, which in turn rotates the arm 54 counterclockwisely through the link member 55. The rotation of the arm 54 rotates the auxiliary guide member 41 counterclockwise through the link member 53.

Thus it is apparent that, by the rotation in counterclockwise direction of the second wrapping roll supporting levers 29, the first, second, and third wrapping rolls 8, 9, and 10 are brought into contact with the coins C stacked on the coin supporting means 12, and simultaneously therewith, the first, second, and third main guide members 38, 39, and 40 and the auxiliary guide members 41, 42, and 43 are brought into the proximities of the stacked coins C. In this state, since cutouts 52 and projections 56 formed respectively on the edges of the main and auxiliary guide members are in the meshed state, the inner surfaces of the end portions of the main guide members form the extended parts of the arcuate inner surfaces of the auxiliary guide members, respectively, whereby the space formed by the wrapping rolls is kept in a cylindrical configuration regardless of the various positions of wrapping rolls and the related guide members in accordance with various denominations of the coins.

When a piece of wrapping paper from the wrapping paper feeding device 13 is fed between the second wrapping roll 9 and the main and auxiliary guide members 39 and 43, the paper is caught between the cylindrical surface of the stack of coins C and the wrapping rolls 8, 9, and 10, passed along the inner surfaces of the main and auxiliary guide members, and wrapped around the stack of coins C.

Upon completion of the wrapping by the paper of the stack of coins C, the lever 51 is rotated by the cam 49 on the cam shaft 33 in the clockwise direction around the shaft 23, and therefore the third main guide member 40 is caused to retract from the position between the first wrapping roll 8 and the second wrapping roll 9. The retraction of the third main guide member 40 from the aforementioned position is caused by a movement thereof around two points, one being the shaft 23 and other being the connecting point between the link member 48 and the guide member 40, upon rotation of the lever 51. By the movement of the third main guide member 40, the arm 54 is rotated, through the link member 55, around the shaft 23 in the counterclockwise direction, and by this rotation of the arm 54, the first auxiliary guide member 41 is rotated through the link member 53 around the shaft of the first wrapping roll 8 in the counterclockwise direction. The first auxiliary guide member 41 is thus retracted from the position between the first wrapping roll 8 and the third wrapping roll 10.

Accordingly, a space between the first and third wrapping rolls 8 and 10 is opened, and the arms 15 having crimping hooks 14, respectively, are swung and thus advanced into the space between the first and third wrapping rolls for fold-crimping the laterally projecting edges of the wrapping paper. After the crimping, a supporting means (not shown) retracts, and the coins thus wrapped are delivered through the coin delivering port.

As described hereinabove, in a coin wrapping device incorporated in a coin wrapping apparatus, wherein a predetermined number of coins are stacked and wrapped by a piece of wrapping paper, according to the present invention, there are provided main and auxiliary guide members between the wrapping rolls constituting the coin wrapping device, in a manner such that the guide members are movable in synchronism with the movements of the wrapping rolls in accordance with the denomination of the coins, and by these guide members, the spaces between the wrapping rolls are closed. Accordingly, any possibility of the coin stack collapsing between the wrapping rolls, and the coins falling loose and jamming the wrapping mechanism can be eliminated, and satisfactory wrapping of coins can be thereby obtained. Furthermore, by the intermeshing construction of the tip edges of the main guide members and the auxiliary guide members, smooth inner surfaces defining a cylindrical space therewithin can be formed by these members, and the above described difficulties can be eliminated more satisfactorily.

We claim:

1. In a coin wrapping apparatus having a coin counting device for counting a predetermined number of coins; a coin stacking and wrapping device provided below said coin counting device for directly receiving therein the counted coins and stacking them, the coin stacking and wrapping device comprising a plurality of vertically positioned wrapping rolls positioned around a central space among said rolls, means for moving said wrapping rolls toward and away from the center of said space, means for rotatably driving said rolls, sheet feeding means for feeding a wrapping sheet during said rotation of said rolls and when a coin-stack is present in said space for wrapping the sheet around the coin-stack, a fold-crimping device for fold-crimping the lateral projecting edges of the wrapped sheet during the wrapping operation, and a main guide member and an auxiliary guide member between each pair of the adjacent wrapping rolls, said plurality of wrapping rolls and guide members defining a substantially continuous inside cylindrical wall around said space for stacking therein one by one the counted coins dropped directly from the counting device, and said guide members being connected to said means for moving said wrapping rolls for movement toward and away from the center of the space in synchronism with the movements of the wrapping rolls in accordance with outer diameter of the coins to be processed.

2. A coin stacking and wrapping device as claimed in claim 1, in which the end portions of said main guide members and said auxiliary guide members have toothed shape portions, the toothed shape portions of the pairs of guide members between adjacent wrapping rolls being intermeshed for forming the inside wall of the cylindrical space.

* * * * *